United States Patent [19]

Bourgeois

[11] 4,359,517

[45] Nov. 16, 1982

[54] DIFFUSION TRANSFER PRODUCTS WITH TWO TIMING LAYERS FOR PRODUCTION OF TRANSPARENCIES

[75] Inventor: Gerard J. Bourgeois, Kingston, N.H.

[73] Assignee: Polaroid Corporation, Cambridge, Mass.

[21] Appl. No.: 259,102

[22] Filed: Apr. 30, 1981

[51] Int. Cl.[3] ..... G03C 1/40; G03C 5/54

[52] U.S. Cl. ..... 430/213; 430/215; 430/238

[58] Field of Search ..... 430/213, 215, 238

[56] References Cited

U.S. PATENT DOCUMENTS

| | | | |
|---|---|---|---|
| 3,362,819 | 1/1968 | Land | 430/215 |
| 3,753,764 | 8/1973 | Haefner | 430/215 |
| 3,756,814 | 9/1973 | Bedell | 430/213 |
| 3,778,265 | 12/1973 | Land | 430/216 |
| 4,009,030 | 2/1977 | Abel | 430/215 |
| 4,061,496 | 12/1977 | Hannie et al. | 430/215 |
| 4,080,346 | 3/1978 | Bedell | 430/213 |

*Primary Examiner*—Richard L. Schilling
*Attorney, Agent, or Firm*—Louis G. Xiarhos

[57] ABSTRACT

Image-receiving elements and photographic diffusion transfer products providing diffusion transfer transparency images are described. The image-receiving elements include a transparent support carrying, in sequence, an acid-reacting reagent; a first polymeric timing layer possessing decreasing alkaline solution permeability with increasing temperature; a second timing layer comprising cellulose acetate; and an alkaline solution-permeable and dyeable polymeric image-receiving layer comprising a graft polymer having a polymeric backbone and grafted thereto moieties which provide mordant capability. The utilization in the image-receiving elements of the aforedescribed first and second timing layers permits the provision of elements which can be effectively processed over a range of processing temperatures and which are adapted to the provision of transparencies which exhibit desired images without the distracting or otherwise objectionable image defects associated with reticulation.

43 Claims, 2 Drawing Figures

DIFFUSION TRANSFER PRODUCTS WITH TWO TIMING LAYERS FOR PRODUCTION OF TRANSPARENCIES

BACKGROUND OF THE INVENTION

This invention relates to image-receiving elements and to diffusion transfer photographic products and processes utilizing same. More particularly, it relates to the utilization of an image-receiving element in a diffusion transfer product adapted to the provision of diffusion transfer images in the form of transparencies.

Diffusion transfer photographic products and processes have been described in numerous patents, including, for example, U.S. Pat. Nos. 2,983,606; 3,345,163; 3,362,819; 3,415,644; 3,573,044; 3,594,164; and 3,594,165. In general, diffusion transfer photographic products and processes involve film units having a photosensitive system including at least one silver halide layer, usually integrated with an image-providing material, e.g., an image-providing dye. After photoexposure, the photosensitive system is developed, generally by uniformly distributing an aqueous alkaline processing composition over the photoexposed element, to establish an imagewise distribution of a diffusible image-providing material. The image-providing material is selectively transferred, at least in part, by diffusion to an image-receiving layer or element positioned in a superposed relationship with the developed photosensitive element and comprising at least a dyeable stratum capable of receiving the imagewise distribution of image-providing material with formation of the desired transfer image.

Various formats have been utilized for the provision of color diffusion transfer images including the so-called "integral negative-positive" film units and so-called "peel-apart" formats. In accordance with the integral negative-positive film units, the image-receiving layer or element containing the photographic image for viewing can remain permanently attached and integral with the photosensitive or image-generating system or layers and the image is viewed through a transparent support against a suitable reflecting background. Such integral negative-positive formats are described, for example, in the aforementioned U.S. Pat. Nos. 3,415,644; 3,573,044; 3,594,164; and 3,594,165. Other, so-called "peel-apart", formats for color diffusion film units or assemblages are described, for example, in the aforementioned U.S. Pat. Nos. 2,983,606; 3,345,163; and 3,362,819, and involve the separation of the image-receiving element from the photosensitive element after development and transfer of the dyes to the image-receiving layer. The image is viewed, after separation of the elements, as a reflection print where an opaque support for the image-receiving layer is utilized or as a transparency image where a transparent support material is employed.

Image-receiving elements suited to the provision of reflection prints or transparencies, by separation from the photosensitive system after development and dye transfer, will typically comprise a suitable support, having thereon a neutralizing or acid-reacting layer for control of the environmental pH of the diffusion transfer process, a timing or spacer layer in conjunction with the neutralizing layer to control the initiation and rate of capture of alkali by the neutralizing or acid-reacting layer and a dye image-receiving layer. Such image-receiving elements and further details concerning their use in diffusion transfer film units or assemblages can be found in the aforementioned U.S. Pat. No. 3,362,819.

It has been known that the particular permeability characteristics of a polymeric layer utilized as an alkaline solution-permeable timing or spacer layer in a diffusion transfer product or process may greatly influence the quality of diffusion transfer photographic images. Thus, there is described in each of U.S. Pat. Nos. 3,419,389 (issued Dec. 31, 1966 to H. C. Haas et al.); 3,421,893 (issued Jan. 14, 1969 to L. D. Taylor); 3,443,633 (issued Mar. 18, 1969 to H. C. Haas); 3,455,686 (issued July 15, 1969 to L. C. Farney et al.); and 3,575,701 (issued Apr. 20, 1971 to L. D. Taylor), the advantageous utilization as polymeric timing or spacer layers of polymeric materials which exhibit permeability to the alkali of an alkaline processing composition inversely with increasing temperature. Such materials permit improved processing temperature latitude and obviate image defects which result from overextended maintenance of pH or premature pH reduction.

While polymeric layers which exhibit permeability to alkali according to an inverse temperature dependency advantageously provide improved processing temperature latitude, certain deficiencies in such polymeric layers may be observed. Thus, a polymeric timing layer exhibiting inverse-temperature permeability characteristics may be utilized in an image-receiving element adapted to the provision by diffusion transfer of a transparency image on a suitable transparent support. The conditions to which a transparency is subjected under normal conditions of usage determine in great measure the suitability of the various materials or components employed in the manufacture of such transparency. For example, defects such as reticulation in a timing or other layer may become apparent as the result of photographic processing with an aqueous alkaline processing composition. Thus, reticulation in a transparency, depending upon the degree of magnification employed for projection viewing, may become especially noticeable or objectionable.

In addition to consideration of physical defects in a transparency and their manifestations under conditions of usage, an image-receiving layer utilized in a transparency must be capable of mordanting or otherwise fixing a sufficient quantity of image-forming dye as to provide acceptable color saturation. Relative to an image-containing layer of a reflection print, the image-containing layer of a transparency, viewed by transmitted rather than reflected light, will have a greater density of image-forming dye. A suitable image-receiving layer for a transparency will, thus, have appreciable mordanting capacity so as to permit the attainment of adequate dye-image saturation.

It is an object of the present invention to provide an image-receiving element adapted to the provision of a transparency by photographic diffusion transfer processing over a range of temperatures.

It is another object of the present invention to provide such an image-receiving element suited to the provision of transparencies free of objectionable reticulation.

Still another object of the present invention is the provision of an image-receiving element adapted to the provision of transparencies exhibiting high dye-image density or saturation.

It is another object of the present invention to provide a diffusion transfer product and process effective for the provision of such transparency images.

Other objects will become apparent from the description appearing hereinafter.

SUMMARY OF THE INVENTION

These and other objects can be achieved by the present invention which, in one of its product or article aspects, provides an image-receiving element comprising a suitable transparent support material carrying, in sequence, an acid-reacting reagent layer; a first polymeric timing layer possessing decreasing alkaline solution permeability with increasing temperature; a second timing layer comprising cellulose acetate; and an alkaline solution-permeable and dyeable polymeric image-receiving layer comprising a graft copolymer having the formula

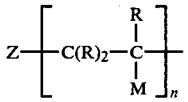

wherein Z is an organic polymeric backbone and wherein the grafted entity,

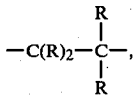

is the grafted residue of a graftable compound where M is a moiety which can provide a mordant capability, each R is the same or different substituent which will not hinder grafting of the mordant moiety M through the vinyl group, and n is a positive integer. It has been found that the combined employment of the aforesaid first and second timing layers and graft polymer image-receiving layer permits the production of an image-receiving element adapted to photographic diffusion transfer processing over a broad latitude of temperatures while providing transparencies which exhibit the dye-density levels or saturation desired in a transparency without the distracting or otherwise objectionable image defects associated with reticulation.

In another of its product or article aspects, the present invention provides photographic diffusion transfer products comprising a photosensitive element and an image-receiving element adapted to be separated from the developed photosensitive element after image formation, the image-receiving element being as aforedescribed.

In its method aspect, the present invention provides a process for forming a diffusion transfer transparency image whereby a photosensitive element is photoexposed, a processing composition is uniformly distributed over the photoexposed element, and an imagewise distribution of diffusible dye image-providing materials is formed as a function of development and transferred imagewise to an image-receiving element as aforesaid described. At least a portion of such diffusible dye image-providing material is transferred imagewise to the image-receiving layer positioned in superposed relationship with the photosensitive element. At the end of an appropriate imbibition, the image-receiving element is separated from its superposed relationship with the developed photosensitive element to permit viewing of the transferred transparency image. The resulting transfer image in the image-receiving layer of the image-receiving element of the invention exhibits desireable saturation and can be viewed by projection without objectionable blemishes or imperfections related to reticulation.

Various objects, details, constructions, operations, uses, advantages and modifications of the invention will be apparent from the following description, taken in conjunction with illustrative drawing of certain embodiments thereof.

THE DRAWING

DETAILED DESCRIPTION OF THE INVENTION

Figure 1:
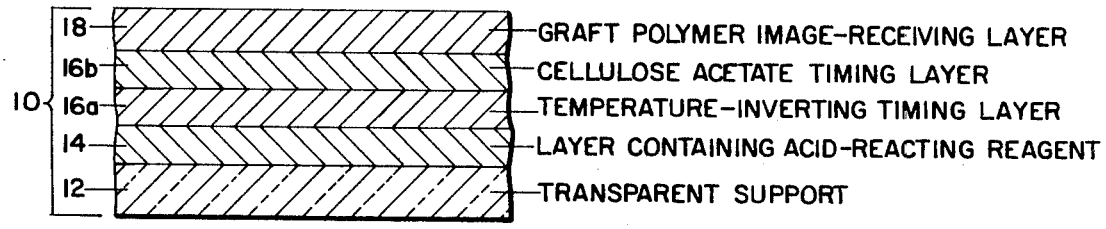
FIG. 1 is a diagrammatic cross-sectional view of a preferred image-receiving element of the invention showing an acid-reacting reagent layer, a temperature-inverting timing layer, a cellulose acetate timing layer and a graft polymer image-receiving layer.

As used herein, the term "transparency" refers to the image-receiving element of the present invention having an image in the image-receiving layer thereof and refers likewise to such transparency suitably mounted in a frame mount or like carrier for conventional projection viewing. The image-receiving element of the present invention, utilized in the manufacture of transparencies, finds particular applicability to diffusion transfer methods employing dye developers as dye image-forming materials. In general, and as set forth, for example, in U.S. Pat. Nos. 2,983,606 (issued May 9, 1961 to H. G. Rogers) and 3,345,163 (issued Oct. 3, 1967 to E. H. Land et al), such diffusion transfer methods involve the imagewise diffusion of image-providing materials associated with a photosensitive element to an image-receiving element. A processing composition is applied to an exposed photosensitive emulsion to effect development thereof and formation of an imagewise distribution of diffusible, unoxidized dye developer as a function of development. Diffusible dye developer is transferred imagewise to an image-receiving layer positioned in superposed relationship with the photosensitive emulsion, and upon separation of the image-receiving element from its superposed relationship with the developed photosensitive emulsion, the transfer image can be viewed. The image-receiving element of the invention, as pointed out hereinbefore, comprises certain essential components importantly related to the attainment of desirable objectives hereinbefore described. These elements are described in greater detail hereinafter and by reference to the drawing hereof.

Referring to the drawing, there is shown in FIG. 1 a preferred image-receiving element of the invention comprising a transparent support 12 carrying, in turn, a layer 14 containing an acid-reacting reagent, temperature inverting timing layer 16*a*, cellulose acetate timing layer 16*b* and graft polymer image-receiving layer 18 comprising a layer of graft polymer having a polymeric backbone and grafted thereto moieties providing mordant capability.

Support material 12 can comprise any of a variety of transparent support materials. Typically, support material 12 will comprise a dimensionally stable support onto which the remaining layers of image-receiving element 10 can be suitably applied and will include glass or polymeric support materials derived from naturally occuring products or of a synthetic type. Thus, methyl and ethyl esters of polymethacrylic acid; vinyl chloride polymers; polyvinyl acetal; polyamides such as nylon; polyesters such as ethylene glycol terephthalate or such cellulosic derivatives as cellulose acetate, triacetate, nitrate, propionate, butyrate, acetate-propionate or acetate-butyrate can be suitably employed. It will be appreciated that, in the case of a transparency where a photographic image is viewed through the support material, a transparent support material will be utilized. A preferred support material is a transparent and dimensionally stable web or sheet material such as polyethylene glycol terephthalate.

The support material can, where desired, be subjected to a pretreatment step prior to the application of acid-reacting layer 14, timing layers 16*a* and 16*b* and graft polymer image-receiving layer 18. Such pretreatment step can be employed to facilitate adhesion between the polymeric acid layer and the support material and can comprise, for example, a corona discharge treatment as is known in the art. Polymeric layers, of vinylidene chloride, gelatin, polyvinyl alcohol or the like can also be utilized as sub-coats onto which the remaining layers of article 10 can be suitably deposited.

In FIG. 1 is shown an image-receiving element 10 embodying an acid-reacting layer 14. The utilization and function of an acid-reacting layer in an image-receiving element for control of pH within a diffusion transfer process is known and described, for example, in U.S. Pat. Nos. 3,362,819; 3,577,237; and 3,756,815. In general, acid-reacting reagent layer 14 provides an important function in controlling environmental pH within a diffusion transfer process and in promoting image stability. The acid-reacting reagent layer, which preferably comprises a polymeric acid material having nondiffusible acid groups, acts to capture alkali ions thereby appreciably reducing the pH or alkalinity of the surface of the image-receiving layer. This reduction in pH is timed to begin after the image dyes have in part been transferred to the image-receiving element and is at least partially completed prior to exposure of the image layer to air. As a result, the alkalinity or pH of the image dye environment in the image-receiving layer may be controlled and adjusted to a level advantageous for image stability.

The acid-reacting reagent-containing layer preferably includes non-diffusible acid groups, for example, acid groups attached to a polymer so as to be non-diffusible. This method of pH reduction in effect, washes the image layer by internally diffusing the alkali ions and salt-forming reagents out of the image layer and into the acid-reacting layer where they are precipitated. The acid-reacting layer, thus, may be considered to be a mordant for alkali. In practice, a layer containing an acid-reacting polymer and, particularly, a polymer containing free carboxyl groups is provided in the image-receiving element and is positioned adjacent the support 12. A preferred acid-reacting polymeric material suited for application as reagent layer 14 is a partial butyl ester of an ethylene/maleic anhydride copolymer. Other acid-reacting reagent layer materials are, however, known and can be suitably employed. Examples of suitable acid-reacting reagents for the formation of acid-reacting layer 14 are set forth, for example, in U.S. Pat. No. 3,362,818, incorporated by reference.

Temperature-inverting timing layer 16*b* provides important functions in the image-receiving layer of the invention. It is disclosed in U.S. Pat. No. 3,575,701, issued Apr. 20, 1971 to L. D. Taylor (and in U.S. Pat. Nos. 3,419,389; 3,421,893; 3,433,633; and 3,455,686) that the diffusion rate of an alkaline processing composition through a permeable inert polymeric timing or spacer layer increases with increased processing temperature to the extent, for example, that at relatively high transfer processing temperatures, that is, transfer processing temperatures above approximately 80° F., a premature decrease in the pH of the transfer processing composition occurs due, at least in part, to the rapid diffusion of alkali from the dye transfer environment and its subsequent neutralization upon contact with the polymeric acid layer. This has been disclosed to be especially true of alkali traversing a timing layer possessing optimum alkali-permeability characteristics within the temperature range of optimum transfer processing. Conversely, at temperatures below the optimum transfer processing range, for example, temperatures below approximately 65° F., such a timing layer provides an effective diffusion barrier timewise preventing effective traverse of the timing layer by alkali having temperature depressed diffusion rates. This barrier results in maintenance of the high pH of the transfer processing environment for such an extended time interval as to facilitate formation of transfer image stain and resulting degradation of the color definition of the positive transfer image.

It is also disclosed in the hereinbefore-referenced patents that, if there is utilized as a timing layer in the image-receiving element a permeable polymeric layer which exhibits permeability inversely dependent upon temperature, and specifically a polymeric film forming material which exhibits decreasing permeability to solubilized alkali derived cations such as alkali metal and quaternary ammonium ions under conditions of increasing temperature, the positive transfer image defects resulting from the aforementioned overextended pH maintenance and/or premature pH reduction can be obviated.

Polymer layer 16*a* comprises a polymeric layer which exhibits inverse temperature-dependent permeability to alkali. The terms "temperature-inverting" and "inverse temperature-dependent" are utilized herein in reference to polymers and polymeric layers to signify polymeric materials which generally exhibit decreased solubility in aqueous solution with increased temperature and polymeric layers which exhibit decreasing permeability to solubilized alkali derived ions under conditions of increasing temperature. Examples of polymers which exhibit inverse temperature-dependent permeability to alkali and which are suited to application as timing layer 16*a* include hydroxypropyl cellulose; polyvinyl methyl ether; polyethylene oxide; polyvinyl oxazolidinone; hydroxypropyl methyl cellulose; partial acetals of polyvinyl alcohol such as partial polyvinyl acetal, partial polyvinyl propional; and the like. Other examples include the polyvinyl amides of U.S. Pat. No. 3,421,893 such as copolymers of diacetone acrylamide and acrylamide, copolymers of N-isopropyl acrylamide and N[$\beta$-(dimethylamino)ethyl] acrylamide, copolymers of N-isopropyl acrylamide and N-methylol acrylamide, terpolymers of diacetone acrylamide, acrylamide and N-dimethylamino ethyl acrylate, and copolymers of diacetone acrylamide and dimethylamino ethyl acrylamide; the cyanoethylated polyvinyl alcohols of U.S. Pat. No. 3,419,389 such as cyanoethylated polyvinyl alcohol where from about 47 to 62.5% of hydroxyl groups have been converted to cyanoethyl ether groups; and the polyvinyl amide graft copolymers of U.S. Pat. No. 3,575,701 such as diacetone acrylamide graft on polyvinyl alcohol, a diacetone acrylamide graft on the partial acetal of polyvinyl alcohol-methoxy acetaldehyde, or the like.

A preferred temperature inverting polymer useful for the provision of timing layer 16*a* comprises hydroxypropyl cellulose which provides superior processing temperature latitude. Preferably, the hydroxypropyl cellulose will have an M.S. of about 2 to 5 and most preferably an M.S. value of about 2 (average number of moles of reactant combined with the cellulose per anhydroglucose unit during hydroxypropylation, which may be determined by the terminal methyl method reported by Lemieux and Purves beginning at page 485, Vol. 25B, 1947, of the Canadian Journal of Research and/or by the percent carbon method, according to the disclosure of U.S. Pat. Nos. 3,278,520 and 3,278,521, both issued Oct. 11, 1966 and E. D. Klug) and may be prepared according to the processes set forth in the last-identified patents. As stated in the last-identified patents, hydroxypropyl cellulose having an M.S. value of about 2 becomes insoluble in water at a temperature above about 60° C. while such a material having an M.S. value of about 4 becomes insoluble in water at a temperature above about 40° C., recognizing that the respective solubility in water varies inversely with viscosity. Hydroxypropyl cellulose materials suitable herein include the commercially available Klucel polymers, inclusive, for example, of Klucel L and the aminated hydroxypropyl cellulose materials such as Klucel G and Klucel H (from Hercules, Inc., Wilmington, Delaware).

Timing layer 16*a* can be deposited upon acid-reacting layer 14 in known manner. Timing layer 16*a* will be deposited from a solution of the temperature-inverting polymer in a suitable solvent such as water, an organic solvent, e.g., methanol, or a mixture thereof. Best results from the standpoint of compatibility with cellulose acetate timing layer 16*b* are obtained when timing layer 16*a* is prepared from a solution of the temperature-inverting polymer in water or in an organic solvent such as methanol. It will be appreciated that coverage of timing layer 16*a* can be varied depending upon solubility of the particular temperature-inverting polymer in the solvent of choice, on the molecular weight of the particular temperature-inverting polymer, on the viscosity of the resulting coating solution and the like.

Cellulose acetate timing layer 16*b* constitutes an important component of the image-receiving element of the invention. In addition to providing with first timing layer 16*a* a means for controlling the initiation and the rate of capture of alkali by the acid-reacting layer 14 to, thus, "time" control the pH adjustment by the neutralization layer 14, cellulose acetate timing layer 16*b* contributes importantly to the favorable non-reticulating aspect of transparencies of the present invention.

It has been found from attempts at the manufacture of image-receiving transparency elements having acid-reacting and timing layers, that the particular nature of the timing layer materially influences the quality of a transparency produced by diffusion transfer processing of a film unit including such an image-receiving element. Thus, the utilization of a temperature-inverting polymeric material as a timing layer in such an image-receiving element, while effective to provide desired processing-temperature latitude, may contribute undesirably to imperfections in the form of reticulation observed on the surface of a transparency produced by diffusion transfer processing. Such reticulation is observed upon inspection of the surface of image-bearing layer 18 as a coarseness of texture or uneveness akin to a minutely pebbled surface. Reticulation of the polymeric timing layer material becomes observable on the surface of the image-receiving layer as the result of the image-receiving layer material conforming to any reticulated or non-uniform texture of the underlying timing layer material. While applicant does not wish to be bound by any precise theory in explanation of polymer film reticulation, it is believed that such reticulation is the result of non-uniform or discontinuous polymer swelling of the polymeric layer caused by contact of the polymeric layer with an aqueous alkaline processing composition and permeation of the layer by the processing composition, such that a network or reticulation of swelled polymer is observed within expansive areas of polymer film having greater wet strength and resistance to swelling. The presence of polymer film reticulation in a transparency element, while often only noticeable upon close inspection, becomes especially evident upon projection viewing and the magnification normally associated with such viewing.

The employment of a cellulose acetate timing layer 16*b* in superposed relation to timing layer 16*a* permits the production of transparencies which upon inspection appear to be substantially non-reticulating. Thus, transparencies prepared by diffusion transfer processing of film units including image-receiving elements having first and second timing layers 16*a* and 16*b*, respectively, can be projected for viewing without the objectionable blemishes associated with highly reticulated transparencies.

While applicant does not wish to be bound by any precise theory or explanation of mechanism or mode of operation by which improvements in reticulation performance are realized, the smoothness and non-reticulating character of cellulose acetate timing layer 16*b* are believed to be involved. This layer is believed to effectively mask the reticulating character of timing layer 16*a* which, but for the superposed cellulose acetate timing layer 16*b*, would be manifest in transparencies in the form of objectionable blemishes or defects. Cellulose acetate timing layer 16*b* provides a surface which is especially suited to the deposition thereon of a graft polymer image-receiving layer. Thus, the smoothness and non-reticulating aspect of cellulose acetate timing layer 16*b* provides a layer especially compatible with the image-receiving layer.

The cellulose acetates useful for the provision of timing layer 16*b* hereof are cellulose acetates which possess an acetate D.S. (degree of substitution) within the range of about 1.0 to about 3.0 groups per anhydroglucose unit of the cellulosic polymer backbone and in particular cellulose acetate having a D.S. of about 2.4. Mixed esters can also be employed such as cellulose acetate propionate, cellulose acetate butyrate or the like. The cellulose acetate timing layer 16*b* can be conveniently coated over temperature-inverting timing layer 16*a* by conventional methods. Thus, organic solvents such as acetone or methylene chloride or mixtures such as ethyl acetate and methanol can be utilized for the coating of a solution of the cellulose acetate ester and formation of a suitable timing layer 16b.

The utilization of both first and second timing layers 16a and 16b, respectively, in the image-receiving elements of the invention has been found essential to the realization of both satisfactory processing temperature latitude and satisfactory performance from the standpoint of reticulation. Thus, omission of temperature-inverting timing layer 16b in image-receiving element 10, i.e., utilization of cellulose acetate layer 16b as a sole timing layer in image-receiving element 10, has been found to result in the provision of transparencies exhibiting very desirable non-reticulation character but which are not readily processed to superior quality at temperatures significantly lower or higher than an optimal processing temperature of about 75° F. The omission of cellulose acetate timing layer 16b, i.e., utilization of temperature-inverting timing layer 16a as a sole timing layer in image-receiving layer 10 has been found to result in the provision of transparencies which are not effectively processed over a satisfactory range of processing temperatures and which exhibit a greater level of reticulation.

Figure 2:
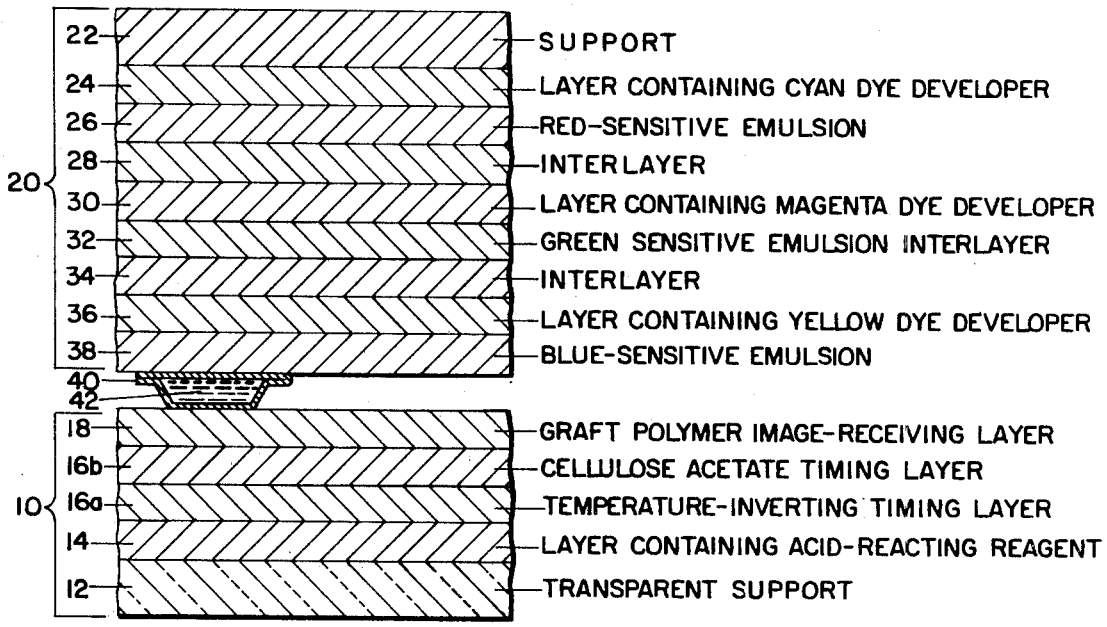
FIG. 2 is a diagrammatic cross-sectional view of a diffusion transfer unit comprising a photosensitive element in association with a rupturable container holding a liquid processing composition and an image-receiving element as shown in FIG. 1.

The relative positioning of timing layers 16a and 16b, as shown in FIGS. 1 and 2, has also been found essential to the realization of satisfactory results from the standpoints of both processing-temperature latitude and reticulation. Thus, where timing layers 16a and 16b of image-receiving element 10 are in a reversed sequence, such that image-receiving layer 18 is superposed upon temperature-inverting timing layer 16a, a greater level of reticulation is observed in the resulting transparencies, although processing-temperature latitude is satisfactory. These results are believed to be attributable to the tendency of image-receiving layer 18 to conform in configuration to the reticulated surface of the temperature-inverting timing layer. According to the present invention, however, important processing-temperature latitude is realized by the utilization of timing layers 16a and 16b in the relative positions shown in FIGS. 1 and 2. At the same time, the manifestation of reticulation in the transparencies as the result of the tendency of timing layer 16a to become reticulated upon diffusion transfer processing is effectively minimized by the presence of superposed cellulose acetate timing layer 16b which is substantially non-reticulating and which provides a compatible surface for image-receiving layer 18. If desired, timing layers 16a and 16b of article 10 can be separated by one or additional layers. Thus, an additional polymeric layer can, for example, be utilized between timing layers 16a and 16b to provide predetermined timing control or to promote adhesion or compatibility between timing layers 16a and 16b. It will be preferred, however, that timing layers 16a and 16b be contiguous to one another.

The coverages of timing layers 16a and 16b can vary depending upon the polymeric materials utilized in the production thereof, molecular weights thereof, the solvents utilized and desired photographic performance. A change in the coverage of one of layers 16a or 16b may necessitate a change in coverage of the other consistent with the realization of performance advantages described hereinbefore.

The graft polymer utilized herein as image-receiving layer 18 constitutes an important component of the image-receiving element of the present invention. The graft polymer, comprising a polymeric backbone material having grafted thereon moieties providing dye mordanting capability, contributes importantly to the provision of a transparency exhibiting high dye-image density or saturation. The graft polymer has mordanting capability especially suited to application in a transparency, which relative to a reflection print, will have a greater density of dye or dye saturation. The graft polymer hereof exhibits desirable compatibility with cellulose acetate timing layer 16b in permitting formation of an image-receiving layer material coated onto the cellulose acetate timing layer.

The graft polymers utilized herein for the formation of image-receiving layer 18 are polymers having the following formula:

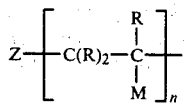

wherein Z is an organic polymeric backbone. The grafted entity, e.g.,

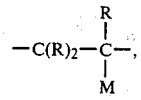

is the grafted residue of a graftable compound where M is a moiety which can provide a mordant capability; each R is the same or different substituent which will not hinder grafting of the mordant through the vinyl group but is preferably hydrogen; and n is a positive integer.

The preferred polymeric backbone, Z, of the graft polymers utilized herein comprises a substituted or unsubstituted polyvinyl polymer or polycellulosic material, preferably selected from the group consisting of polyvinyl alcohols, poly-N-vinylpyrrolidones, polyamides, celluloses, substituted celluloses such as alkyl celluloses, hydroxyalkyl celluloses, alkyl hydroxyalkyl celluloses, alkyl hydroxyalkyl celluloses or the like.

The graft polymers utilized herein can be conveniently prepared by grafting a compound providing mordant capability onto a polymeric backbone material Z comprising repeating units having structural units capable of being oxidized by a transition metal ion catalyst of a first oxidation state; said catalyst having an oxidation potential, in acidic solution, of at least about 1 volt when the transition metal is reduced to the next lowest acidic solution stable oxidation state. Groups capable of being oxidized by a transition metal ion catalyst include those conforming to the formula

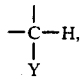

where Y can be hydroxy, amino, mercapto, carboxy and acyl. It is believed that upon oxidation of the

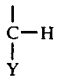

group a free radical is formed, which attacks the graftable site of the compound providing the mordant capability thus providing the graft polymer and/or copolymer.

Graftable compounds which provide a mordant capability for the polymers utilized herein are those which in their monomeric form, conform to the following formula:

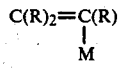

where, as described before, $C(R)_2{=}C(R)$ represents a graftable vinyl site and M is a moiety providing a mordant capability. More precisely, the graft polymers utilized herein comprise a polymeric backbone having grafted thereto at least one of the following graftable compounds

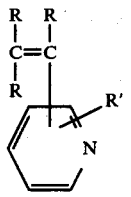

(1)

vinylpyridines
(or quaternary salts thereof)

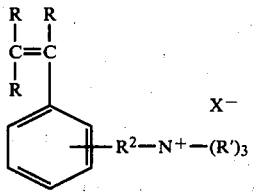

(2)

vinylbenzyl-ammonium salts where each R′ can be the same or different substituent selected from the group consisting of hydrogen, an alkyl radical preferably having from 1–10 carbon atoms or a carbocyclic radical such as aryl, aralkyl and cyclic alkyl; $R^2$ is an alkylene radical having from 1–8 carbon atoms; X represents an anion such as an aryl sulfonate anion, e.g., benzenesulfonate, p-toluenesulfonate etc., an alkylsulfonate anion, e.g., methyl sulfate, ethyl sulfate, n-propyl sulfate, n-butyl sulfate etc., or X can be a halide ion, e.g., iodide, chloride, bromide or other acid anion radical.

Representative vinyl pyridines or quaternary salts thereof particularly preferred in graft polymers hereof include 4-vinyl pyridine, 5-vinyl-2-methyl pyridine, 2-vinyl pyridine, 5-vinyl-2-methyl pyridine tosylate, etc. Representative preferred vinylbenzyl ammonium halides include vinylbenzyl trimethyl ammonium chloride, vinylbenzyl trihexyl ammonium chloride, vinylbenzyl dimethylcyclohexyl ammonium chloride, vinylbenzyl dimethylbenzyl ammonium chloride, vinylbenzyl triethyl ammonium chloride and others of the following formula:

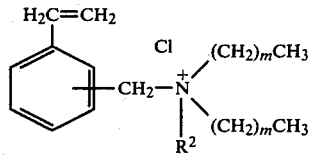

where m = 0–5 and $R^2 = (CH_2)_mCH_3$,

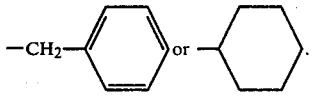

Examples of particularly preferred graft polymers useful herein are:

(1) 4-vinylpyridine grafted on polyvinyl alcohol

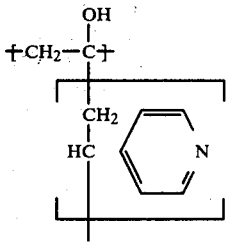

(2) 5-vinyl-2-methylpyridine grafted on polyvinyl alcohol

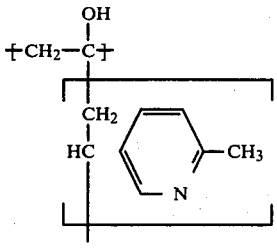

(3) 4-vinylpyridine grafted on methyl cellulose

-continued

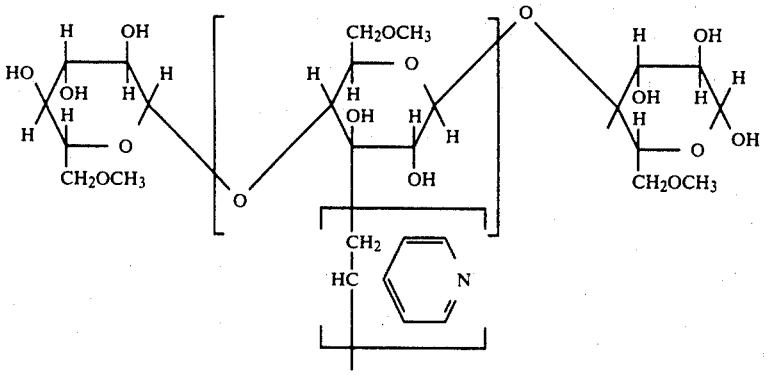

(4) 4-vinylpyridine grafted on hydroxyethyl cellulose

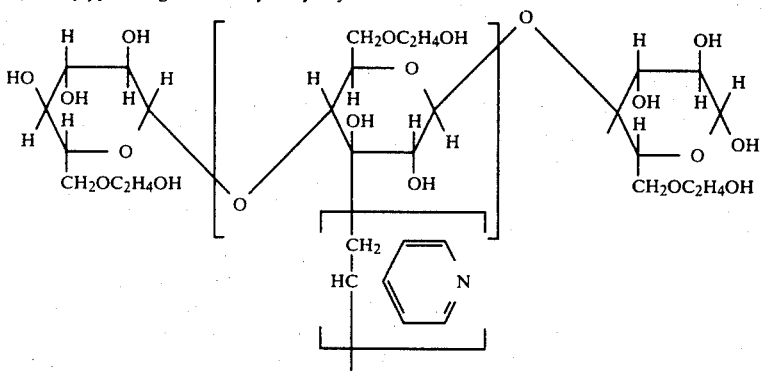

(5) vinylbenzyl-trialkyl-ammonium halides grafted on polyvinyl alcohol

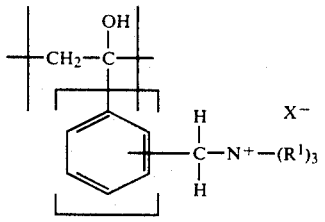

where $R^1$ is alkyl having from about 1-6 carbon atoms and X is a halide.

(6) 4-vinylpyridine grafted on poly-N-vinylpyrrolidone.

(7) 5-vinyl-2-methyl pyridine grafted on hydroxyethyl-cellulose.

(8) 4-vinylpyridine and vinylbenzyl-trimethyl-ammonium chloride grafted on hydroxyethyl-cellulose.

(9) vinylbenzyl-trimethyl-ammonium chloride grafted on hydroxyethylcellulose.

(10) vinylbenzyl-trimethyl-ammonium chloride grafted on polyvinyl alcohol.

(11) 4-vinylpyridine and vinylbenzyl-trimethyl-ammonium chloride grafted on polyacrylamide.

(12) 4-vinylpyridine and vinylbenzyl-dimethyl benzyl-ammonium chloride grafted on hydroxyethyl cellulose.

(13) 4-vinylpyridine and vinylbenzyl-dimethyl cyclohexyl-ammonium chloride grafted on hydroxyethyl cellulose.

(14) vinylbenzyl-dimethyl benzyl-ammonium chloride grafted on polyvinyl alcohol.

(15) vinylbenzyl-dimethyl benzyl-ammonium chloride grafted on hydroxyethylcellulose.

(16) 4-vinyl pyridine and vinylbenzyl-trimethylammonium chloride grafted on polyvinyl alcohol.

Also, the particularly preferred graft polymers herein are those where the weight percent of backbone to grafted vinylpyridine or vinylbenzyl ammonium halide or the total of both is between about 10% to about 90% backbone by weight of the graft polymer. Particularly preferred are those grafts where the weight percent of backbone is between about 20% to about 70% backbone by weight of the graft polymer(s).

Of the above listed representative preferred graft polymers, those containing a mixture of a vinyl pyridine and a vinylbenzyl alkyl ammonium halide grafted to the polymeric backbone—especially to a polyvinyl alcohol or hydroxyalkyl cellulose backbone-are particularly preferred. Such graft polymers provide excellent mordants and latices containing them are remarkably stable. For example, latices containing the particularly preferred graft polymers have been steam distilled and the presence of salts in high concentrations does not affect the stability of the latices.

The graft polymers or copolymers useful herein may be prepared, in general, by oxidizing an organic polymeric backbone material defined before with a transition metal ion catalyst, in the presence of the mordant monomer(s). Generally, a 1–10%, by weight, aqueous solution of the backbone polymer is deaerated for about 30 minutes with stirring. The monomer is then added and nitrogen is bubbled through the solution for about one hour. At this point, the nitrogen is passed over the stirred solution and the pH adjusted to around 1.5 with concentrated acid. The catalyst is dissolved in a minimum amount of water, quickly added to the polymerization mixture and stirring continued under the nitrogen atmosphere for at least two more hours with stirring times up to 24 hours giving no adverse effect to the graft copolymer. The resulting graft polymers are obtained from the reaction vessel in the form of aqueous solutions. They may then be coated directly from solution to provide novel image-receiving layers. However, in preferred embodiments, the pH is raised, e.g., with $NH_3$, to a point at which an aqueous emulsion is formed, generally a pH of around 7, depending at least in part upon the ratio of catalyst to backbone polymer and backbone polymer to mordant monomer.

The choice of catalyst is wide ranging, with particularly good results being obtained when catalysts containing $Ce^{+4}$, $V^{+5}$ and $Cr^{+6}$ are employed in making the graft polymers of the present invention.

Although the pH is generally adjusted to around 1.5 with concentrated nitric acid, pH's of up to about 7 have proven operative in some instances, depending at least in part on the ratio of catalyst to backbone polymer.

Graft polymers of the present invention can also be prepared by grafting a mordant precursor to a polymeric backbone material in the manner described above and thereafter reacting the graft copolymer with a compound that can provide a mordanting capability. For example, vinylbenzyl halides can be grafted to the polymeric backbone materials and the resultant graft polymer reacted with a tertiary amine of the formula:

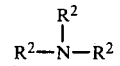

where $R^2$ is as defined before.

In preparing the graft polymers or copolymers of the present invention the weight ratio of backbone/catalyst can be used to control such factors as the particle size of the polymer as well as the temperature permeability characteristics of layers containing the graft polymers. In general, the larger the ratio, the larger the particle size of the polymer. Also, it has been generally found that for any given polymer, the temperature-permeability characteristics of the layers prepared therefrom can be manipulated by the judicious choice of backbone/-catalyst weight ratio. In general, any two polymers having the same backbone, comprised of the same monomers, and having the same monomer to backbone polymer ratio, will result in layers having different diffusion characteristics if they are prepared in the presence of different backbone/catalyst ratios. In general, increasing the backbone/catalyst ratio results in increased permeability. Suitable backbone to catalyst weight ratios are from about 1–20 but generally a backbone to catalyst weight ratio from about 2 to about 10 is the most useful range irrespective of the monomers used.

As was stated hereinbefore, any transition metal ion catalyst of a first oxidation state having an oxidation potential, in acidic solution of at least about 1 volt when the transition metal is reduced to the next lowest acidic solution stable oxidation state, is operable in the present invention. As preferred catalysts, mention may be made of transition metal ion catalysts comprised of a member selected from the group consisting of $V^{+5}$, $Ce^{+4}$ and $Cr^{+6}$.

The graft polymers utilized herein in the formation of image-receiving layer 18 are known materials. Further details so to their preparation and properties can be found in U.S. Pat. No. 4,080,346 (issued Mar. 21, 1978 to Stanley F. Bedell) and incorporated herein by reference.

Image-receiving element 10 can contain other optional materials such as ultraviolet absorbers, effective to improve the light stability or other properties of the positive image. Dye mordants for increased image dye density, coupling components and oxidizing agents for the production of image-forming compounds in known manner can be utilized and incorporated into the image-receiving element. Inasmuch as a transparency image will have a dye saturation relatively greater than that of a reflection print, agents useful in promoting dye transfer rate or saturation can be used to advantage. For example, N-oxides of the type described in U.S. Pat. No. 4,203,766 (Photographic Products Comprising Dye Developers And N-Oxides, issued May 20, 1980 to G. J. Bourgeois, R. A. Gaudiana Gaudiana and R. A. Sahatjian) can be utilized in a diffusion transfer process in conjunction with an image-receiving element hereof for the attainment of enhanced dye transfer rate and saturation.

Image-receiving element 10 can be effectively utilized in a diffusion transfer process as described in the aforesaid U.S. Pat. No. 2,983,606 (issued May 9, 1961 to H. G. Rogers). As disclosed in said patent, a photographic element comprising at least one silver halide emulsion is exposed and subsequently developed in the presence of a dye developer, e.g., a compound which is both a dye and a silver halide developing agent, to impart to an image-receiving layer a reversed or positive dye image of the developed image by permeating into the emulsion, in superposed relationship with an appropriate image-receiving layer, a suitable liquid processing composition.

Preferably, the dye developer is contained initially as a layer in the photosensitive element, although it may be present in the liquid processing composition. The liquid processing composition permeates the emulsion to provide a solution of dye developer substantially uniformly distributed therein. As the exposed silver halide emulsion is developed, oxidized dye developer is immobilized or precipitated in developed areas, thereby providing an imagewise distribution of unoxidized dye developer dissolved in the liquid processing composition as a function of the point-to-point degree of exposure of the photographic element. At least part of this imagewise distribution of unoxidized dye developer is transferred by imbibition, to the superposed image-receiving layer. This image-receiving layer receives a depth-wise diffusion from the emulsion of unoxidized dye developer without appreciably disturbing the imagewise distribution thereof. The image-receiving element hereof can be utilized in diffusion transfer photographic products and is especially suited to the provision of color images by diffusion transfer processes employing dye developers as the color-providing materials. This aspect of the invention will be more fully understood by reference to FIG. 2 of the accompanying drawing.

There is shown in FIG. 2, an integral multilayer, multicolor photosensitive element 20 positioned in superposed relationship with image-receiving element 10. Between photosensitive element 20 and image-receiving element 10, is shown a frangible container 40 containing a processing composition 42. The multicolor photosensitive element 20 comprises a support 22, bearing in turn a layer 24 containing a cyan dye developer, a layer 26 of a red-sensitive silver halide emulsion, an interlayer 28, a layer 30 containing a magenta dye developer, a layer 32 of a green-sensitive silver halide emulsion, an interlayer 34, a layer 36 of a yellow dye developer, and a layer 38 of a blue-sensitive silver halide emulsion.

While photosensitive element 20 is shown as comprising a plurality of silver halide layers and associated dye developers, photosensitive element 20 can comprise a single silver halide emulsion and associated dye developer to provide a monochromatic image, if desired.

The development of photosensitive element 20 is accomplished by spreading an aqueous alkaline processing composition between the exposed photosensitive element and the superposed image-receiving element. Preferably, the processing composition is confined in a rupturable or frangible container 40, positioned as shown in FIG. 2, between the photosensitive element 20 and the image-receiving element.

Development can be initiated by rupturing container 40, e.g., by means of a pair of pressure rollers (not shown), and spreading its contents 42 in a substantially uniform layer between photosensitive element 20 and the adjacent and superposed image-receiving layer 18 of image-receiving element 10. Photosensitive element 20 can be photoexposed by exposure to light impinging upon layer 38 and image-receiving element 10 can thereafter be brought into a superposed relationship with the photoexposed element 20 in the manner generally shown in FIG. 2. Alternatively, photosensitive element 20 can be photoexposed through support 22 thereof, by providing such support of transparent material. It will be appreciated that, in such instance, the photosensitive emulsion layers and associated dyes will be rearranged in known manner such as to permit photoexposure of the emulsion layers in the sequence shown in FIG. 2, i.e., exposure of the blue-sensitive emulsion first, the green-sensitive emulsion next and the red-sensitive emulsion. Development can be initiated by spreading a suitable processing composition between the photoexposed element and the image-receiving element 10 which will be in a superposed relationship or adapted to be superposed before, during or after photoexposure. Where photoexposure through a transparent support 22 is desired, an opaque material (not shown) can thereafter be superposed on supports 12 and 22 so as to permit in-light development. Whether photosensitive element 20 is photoexposed through its support or from the direction opposed to the support, image-receiving element 10 will be adapted to separation from its superposed relationship to element 20. The desired positive image may then be viewed by separating the image-receiving element 10 from the photosensitive element 20 at the end of the imbibition.

The processing compositions employed in diffusion transfer processes of the type contemplated herein usually are aqueous alkaline compositions having a pH in excess of about 12, and frequently in the order of 14 or greater. The liquid processing composition permeates the emulsion layer(s) of the photosensitive element to effect development thereof. The liquid processing compositions utilized in the diffusion transfer processes herein comprise at least an aqueous solution of an alkaline material, for example, sodium hydroxide or the like. The processing composition can include known silver halide developing agents as auxiliary developers. Alternatively, such materials can suitably be included in the photosensitive element in known manner. Preferably, the processing composition will include a viscosity-increasing compound constituting a film-forming material of the type which, when the composition is spread and dried, forms a relatively firm and relatively stable film. The preferred film-forming materials disclosed comprise high molecular weight polymers such as polymeric, water-soluble ethers which are inert to an alkaline solution such as, for example, a hydroxyethyl cellulose or sodium carboxymethyl cellulose or carboxymethyl hydroxyethyl cellulose. Additionally, film-forming materials or thickening agents whose ability to increase viscosity is substantially unaffected if left in solution for a long period of time can also be used.

The film-forming material is preferably contained in the processing composition in such suitable quantities as to impart to the composition a viscosity in excess of 100 cps. at a temperature of approximately 24° C., and preferably, in the order of 40,000 cps. to 100,000 cps. at that temperature. As has been set forth herein, the aqueous alkaline processing compositions will preferably be included in a rupturable or frangible container such as container 40 shown in FIG. 2 of the drawing herein. Examples of suitable rupturable containers and their methods of manufacture can be found, for example, in U.S. Pat. Nos. 2,543,181; 2,634,886; 3,653,732; 3,056,491; and 3,152,515.

While the present invention is illustrated primarily by the description of photographic systems utilizing dye developers, other photographic processes for preparing color images can also be employed. For example, photographic processes based upon oxidation and/or coupling reactions to produce desired color images can be employed. Examples of other useful photographic processes are described in U.S. Pat. Nos. 2,559,643; 2,661,293; 2,698,798; 2,802,735; 2,968,554; 2,774,668; 2,909,430; 3,015,561; 3,087,817; 2,892,710 and 2,992,105. Redox dye releasers such as nondiffusible sulfonamido compounds which are alkali-cleavable upon oxidation to release a diffusible dye can be utilized and are described in U.S. Pat. No. 4,076,529. Also, image dye-providing materials which are initially non-diffusible and which release a diffusible dye or dye intermediate by a coupling or redox reaction can be utilized, as in known in the art and shown, for example, in U.S. Pat. Nos. 3,185,567 and 3,443,939. In general, the photographic processes described in these patents involve an oxidation and/or coupling reaction to provide the desired color image. Utilizing the present invention in the processes thereof, it will be appreciated that the image-receiving element of the present invention will contain the necessary ingredients, e.g., coupling components, oxidizing agents or the like forming the desired color image. These ingredients can be present in image-receiving layer 18 or may be in a separate layer contiguous thereto. Accordingly, the term image-receiving layer, as used herein, includes a layer having the requisite ingredients, e.g., dye mordant, coupling components, oxidizing agents, or the like, suitable, depending upon the particular photographic system employed, for receiving and/or forming a diffusion transfer image.

The following EXAMPLES are provided to illustrate the invention further; however, it should be noted that the invention is not to be interpreted as being limited to the details set forth therein. In all Examples herein, amounts and proportions are by weight. In the multicolor photosensitive element of EXAMPLE III, which includes cyan, magenta and yellow dye developers, the following cyan, magenta and yellow dye developers were utilized.

cyan:

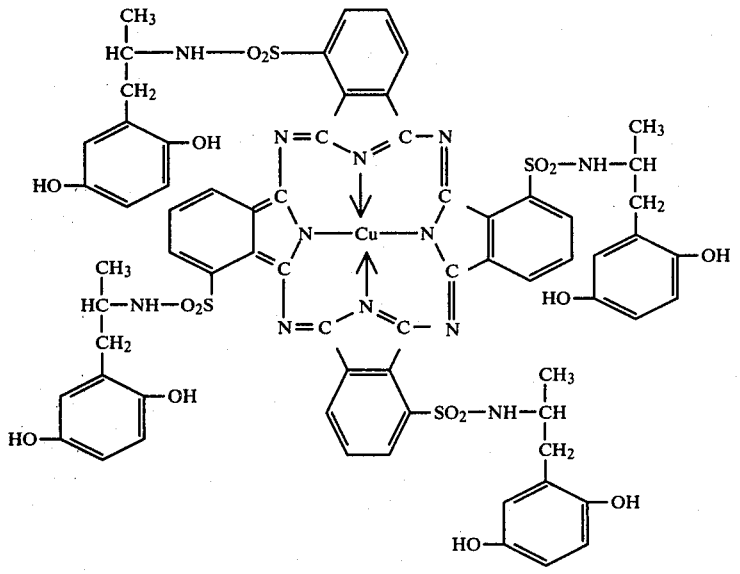

magenta:

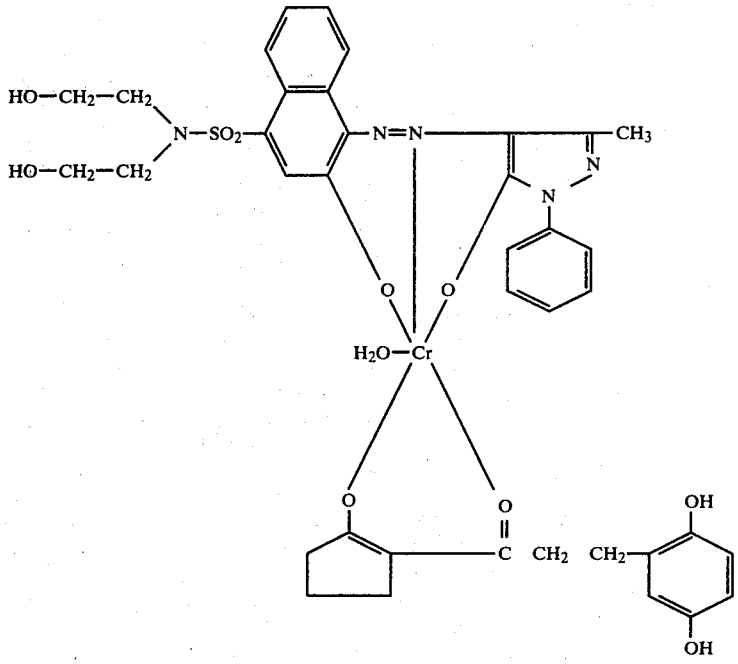

yellow:

-continued

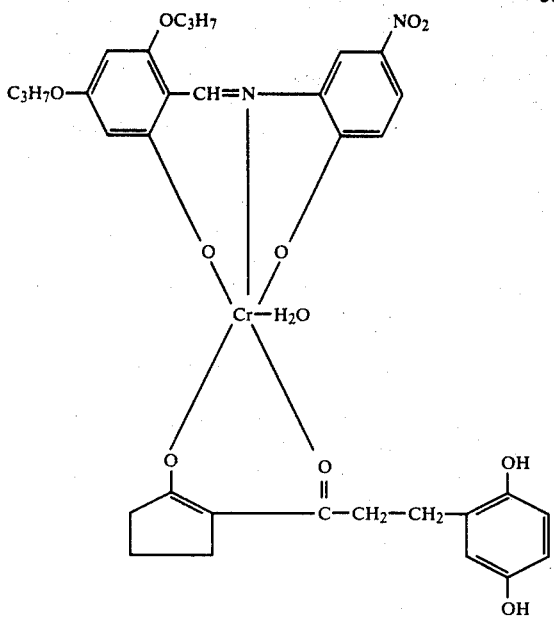

EXAMPLE I

A series of image-receiving elements adapted to the provision of transparencey images by diffusion transfer processing was prepared. Each image-receiving element was prepared by coating a transparent seven-mil (0.18 mm.) polyethylene glycol terephthalate film base, in succession, with the following layers:

1. as a polymeric acid layer, a mixture of about 8:1 of the partial butyl ester of polyethylene/maleic anhydride copolymer and poly(vinylbutyral) at a coverage of about 2500 mgs./ft.$^2$ (26,910 mgs./m.$^2$);

2. as indicated in TABLE I, in the order there indicated, one or two of the following test time-modulation (TTM) layers:

TTM-A—Hydroxypropyl cellulose (Klucel L from Hercules, Inc., Wilmington, Delaware) coated at a coverage of about 1100 mgs./ft.$^2$ (11,840 mgs./m.$^2$).

TTM-B—Cellulose acetate having a D.S. of about 2.4 and coated at a coverage of about 243 mgs./ft.hu 2 (2616 mgs./m.$^2$).

TTM-C—Cellulose acetate having a D.S. of about 2.4 and coated at a coverage of about 100 mgs./ft.$^2$ (1076 mgs./m.$^2$).

TTM-D—Hydroxypropyl cellulose (Klucel L) coated at a coverage of about 800 mgs./ft.$^2$ (8611 mgs./m.$^2$).

3. as a polymeric image-receiving layer, a mixture of (a) a graft copolymer comprised of 4-vinylpyridine (4VP) and vinylbenzyl trimethyl ammonium chloride (TMQ) grafted onto hydroxyethyl cellulose (HEC) at a ratio of HEC/4VP/TMQ of 2.2/2.2/1, (b) Pluronic F-127 polyoxyethylene polyoxypropylene block copolymer wetting agent, avg. mol. wt., about 12,500, from BASF Wyandotte Corp., and (c) a mixture of cis- and trans-4,5-cyclopentatetrahydropyrimidine-2-thiol, component (a) being coated at a coverage of about 700 mgs./ft.$^2$ (7535 mgs./m.$^2$), component (b) at about 10 mgs./ft.$^2$ (107.6 mgs/m.$^2$) and component (c) at about 25 mgs./ft.$^2$ (269.1 mgs./m.$^2$); and 4. a strip-coat from a solution of gum arabic containing ammonium hydroxide and wetting agent and coated at a coverage of about 25 mgs./ft.$^2$ (269.1 mgs./m.$^2$).

In the case of Image-Receiving Elements 1-B and 1-D, described in TABLE I, coverages of the TTM-B, TTM-C and TTM-D layers utilized in the preparation thereof were chosen so as to provide with each of Image-Receiving Elements 1-B and 1-D the same clearing time (described hereinafter in greater detail) at a temperature of 75° C.

Clearing times were determined for each of the Image-Receiving Elements of this Example. These were determined according to the following procedure whereby an alkaline processing composition of high pH, and including an indicator dye which is highly colored at pH's of about 12 to 14 and colorless below about 10, is uniformly spread over the surface of each image-receiving layer with the aid of a transparent polyester spreading sheet. Each image-receiving element and the spreader sheet, with the support of the image-receiving element and spreader sheet outermost, comprise a sandwich-like structure with the processing composition therebetween. The view through the cover sheet toward the image-receiving element is dark (blue) until the alkali of the processing composition penetrates the acid-reacting layer where the pH is reduced and a change of the indicator dye to colorless is effected. The system is considered to have "cleared" when the indicator dye becomes colorless. Clearing of the system can be determined by monitoring the amount of light transmitted through the sandwich as a result of clearing. This is accomplished by a spectrophotometric technique whereby the sandwich is placed between a source of yellow light (an array of yellow light-emitting diodes) and an array of silicon detectors which sum the amount of light transmitted through the sandwich and feed to an amplifier. An electronic comparator is utilized to determine from the amplifier feed the point of 50% light transmission and to automatically shut off a time clock which measures lapse time from the point of spreading of the processing composition. The spectrophotometrically determined 50% transmission point corresponds to 50% clearing of the indicator dye.

Each Image-Receiving Element of this Example was evaluated for clearing time, as aforedescribed, by forming a sandwich comprising the transparent polyester spreader sheet, the image-receiving element and, therebetween, a rupturable container retaining the processing composition. The image-receiving element and spreader sheet were taped together at one end (the spreader sheet and support of the image-receiving element being outermost) with the rupturable container retaining the aqueous alkaline processing composition being so mounted that pressure applied to the container would rupture the marginal seal of the container and distribute the processing composition between the image-receiving element and the spreader sheet. Each sandwich structure was passed through a pair of rollers spaced at 0.0030 inch (0.076 mm.) gap so as to uniformly distribute the processing composition as aforedescribed. Each sandwich structure was processed at temperatures of 65° F. (18.3° C.), 75° F. (23.9° C.) and 85° F. (29.4° C.). The time required (in seconds) to reach 50% clearing as determined by the spectrophotometric technique described was recorded in the case of each sandwich structure and is reported in TABLE I as follows:

TABLE I

| Image-Receiving Element | TTM Layer(s) | Clearing Time (seconds) 65° F. | 75° F. | 85° F. |
|---|---|---|---|---|
| I-A | TTM-A | 134 | 137 | 147 |
| 1-B | TTM-B | 317 | 198 | 107 |
| 1-C | TTM-C/TTM-D* | 262 | 255 | 249 |
| 1-D | TTM-D/TTM-C** | 282 | 204 | 176 |

*TTM-D layer coated over TTM-C layer
**TTM-C layer coated over TTM-D layer

From inspection of the clearing times reported in TABLE I, it will be seen that the utilization of a cellulose acetate timing layer in Image-Receiving Element 1-B resulted in progressively faster clearing at temperatures of 75° F. and 85° F. as compared with the clearing time at 65° F.; and that the utilization of hydroxypropyl cellulose as the timing layer of Image-Receiving 1-A showed progressively slower clearing at 75° F. and 85° F. compared with the clearing time at 65° F. (indicative of the inverse-temperature dependent permeability to alkali). It will also be seen that the utilization of the combination hydroxypropyl cellulose/cellulose acetate in Image-Receiving Element 1-D provided, relative to the cellulose acetate timing layer of Image-Receiving Element 1-B, substantially the same permeability (clearing) at 75° F. but faster clearing at 65° F. and slower clearing at 85° F.

EXAMPLE II

A series of film units adapted to the provision of transparency images by diffusion transfer was prepared. In the case of each film unit, a multicolor photosensitive element was utilized and was prepared by coating, in succession, on a gelatin-subcoated opaque polyethylene terephthalate film base, the following layers:

1. a layer of sodium cellulose sulfate coated at a coverage of about 20 mgs./m.$^2$;
2. a cyan dye developer layer comprising a cyan dye developer represented by the formula

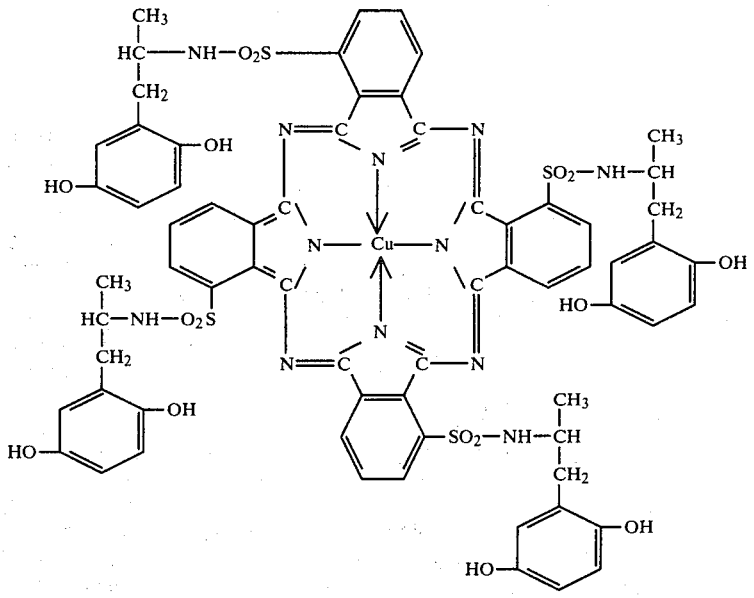

dispersed in a gelatin and coated at a coverage of about 1492 mgs./m.$^2$ of the dye developer and about 748 mgs./m.$^2$ of gelatin;

3. a red-sensitive gelatino silver iodobromide emulsion layer coated at a coverage of about 1665 mgs./m.$^2$ of silver and about 991 mgs./m.$^2$ of gelatin;
4. an interlayer comprising about 1400 mgs./m.$^2$ of a 60.6/29/6.3/3.7/0.4 pentapolymer of butylacrylate, diacetone acrylamide, styrene, methacrylic acid and acrylic acid and about 58 mgs./m.$^2$ of polyacrylamide;
5. a layer comprising the magenta dye developer

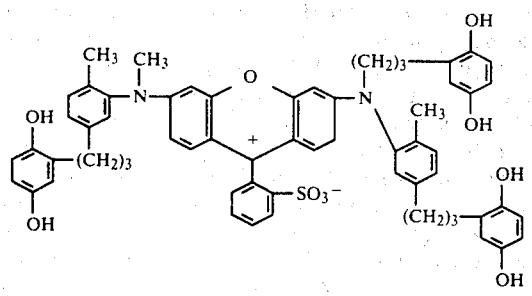

dispersed in gelatin and coated at a coverage of about 880 mgs./m.$^2$ of dye and about 441 mgs./m.$^2$ of gelatin;

6. a green-sensitive gelatino silver iodobromide emulsion layer coated at a coverage of about 1056 mgs./m.$^2$ of silver and about 465 mgs./m.$^2$ of gelatin;

7. an interlayer comprising about 1600 mgs./m.$^2$ of a 60.6/29/6.3/3/7/0.4 pentapolymer of butylacrylate, diacetone acrylamide, styrene, methacrylic acid and acrylic acid and about 178 mgs./m.$^2$ of polyacrylamide;

8. a layer comprising the yellow dye developer

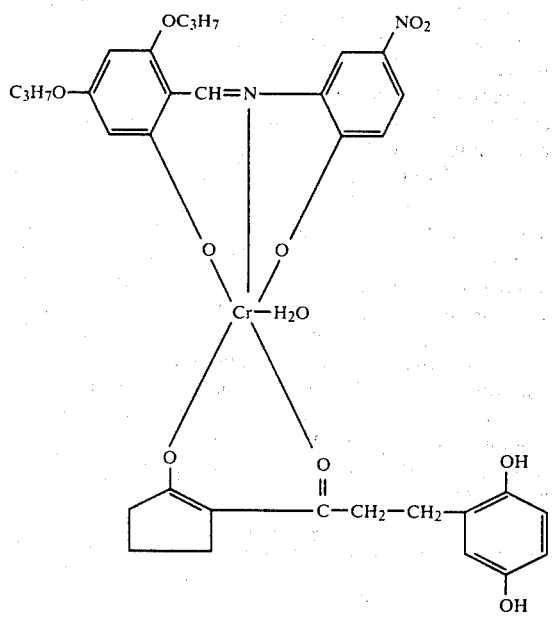

dispersed in gelatin and coated at a coverage of about 1104 mgs./m.$^2$ of dye and about 442 mgs./m.$^2$ of gelatin;

9. a blue-sensitive gelatino silver iodobromide emulsion layer coated at a coverage of about 1248 mgs./m.$^2$ of silver, about 801 mgs./m.$^2$ of gelatin, and about 398 mgs./m.$^2$ of 4'-methylphenylhydroquinone; and 10. a gelatin overcoat layer coated at a coverage of about 430 mgs./m.$^2$ of gelatin.

In the case of each film unit, the photosensitive element hereinbefore described was exposed through a standardized multicolor strip wedge target. Following photoexposure, each photosensitive element was taped to one end of an image-receiving element in a face-to-face relationship with the respective supports outermost. A rupturable container retaining an aqueous alkaline processing composition was fixedly mounted on the leading edge of the superposed elements to provide a film unit, so that, upon application of compressive force on the rupturable container to rupture the container's marginal seal, its contents would be distributed between the photosensitive and image-receiving elements. Each film unit was developed in the dark by passing the film unit through a pair of rollers spaced at 0.0036 inch (0.091 mm.) gap so as to uniformly distribute the processing composition between the elements as aforesaid. Development was conducted at temperatures of 65° F., 75° F. and 85° F.

The image-receiving elements utilized in the film units as aforedescribed were Image-Receiving Elements I-A, I-B, I-C and I-D hereof. In the case of each film unit, the image-receiving element, after a period of imbibition of four minutes, was peeled apart from the developed photosensitive element with the provision in each instance of a multicolor image in the form of a transparency.

In the case of each film unit, the aqueous alkaline processing composition retained in the rupturable container and utilized for processing had the following composition:

| Components | Parts |
|---|---|
| Sodium hydroxide | 7.108 |
| Carboxymethyl hydroxyethyl cellulose | 3.2 |
| Benzotriazole | 1.8 |
| 6-bromo-5-methyl-4-azabenzimidazole | 0.25 |
| Zinc nitrate | 0.80 |
| 3,5-dimethyl pyrazole | 0.20 |
| 6-methyl-uracil | 1.0 |
| 4-amino pyrazolo-(3,4d)pyrimidine | 0.10 |
| N-phenethyl-α-picolinium bromide | 0.75 |
| N-benzyl-α-picolinium bromide | 1.9 |
| Tetrahydrothiophene-1,1-dioxide | 5.04 |
| Bisphenol A | 0.44 |
| Water | 100 |

The transparencies resulting from the processing in the manner aforedescribed provided sensitometric results reported in TABLE II as follows:

TABLE II

| Film | | 65° F. | | | | | | 75° F. | | | | | | 85° F. | | | | | |
|---|---|---|---|---|---|---|---|---|---|---|---|---|---|---|---|---|---|---|---|
| | | Dmax | | | Dmin | | | Dmax | | | Dmin | | | Dmax | | | Dmin | | |
| Unit | TTM Layer(s) | R | G | B | R | G | B | R | G | B | R | G | B | R | G | B | R | G | B |
| 2-A | TTM-A | .73 | 1.46 | 1.22 | .03 | .05 | .05 | 1.04 | 1.76 | 1.54 | .02 | .08 | .08 | 1.16 | 1.82 | 1.57 | .04 | .10 | .10 |
| 2-B | TTM-B | 2.09 | 2.51 | 2.19 | .10 | .15 | .17 | 1.78 | 2.34 | 2.01 | .09 | .16 | .18 | 1.38 | 2.06 | 1.77 | .07 | .15 | .12 |
| 2-C | TTM-C/TTM-D* | 1.85 | 2.23 | 2.03 | .06 | .12 | .15 | 1.91 | 2.31 | 2.05 | .05 | .14 | .15 | 2.18 | 2.41 | 2.07 | .08 | .19 | .17 |
| 2-D | TTM-D/TTM-C** | 2.06 | 2.36 | 2.08 | .09 | .14 | .15 | 1.92 | 2.34 | 2.00 | .09 | .18 | .18 | 1.81 | 2.24 | 1.94 | .08 | .17 | .14 |

*TTM-D layer coated onto TTM-C layer
**TTM-C layer coated onto TTM-D layer

From inspection of the sensitometric data reported in TABLE II, it will be seen that the transparency prepared from Film Unit 2-D (having hydroxypropyl cellulose/cellulose acetate timing layers) showed higher $D_{max}$ values at 85° F. than those obtained for the transparency prepared from Film Unit 2-B (having a cellulose acetate timing layer). Similarly, $D_{max}$ values at 65° F. for the transparency prepared from Film Unit 2-D were slightly lower than those recorded for the transparency prepared from Film Unit 2-B. These results are indicative of the slower clearing at 85° F. and faster clearing at 65° F. in the case of Film Unit 2-D relative to Film Unit 2-B.

Inspection of the transparencies obtained from Film Unit 2-B processed at 65° F. showed evidence of "salting" attributable to maintenance of an overextended high-pH condition, i.e., too slow clearing at 65° F. No evidence of this salting phenomenon was observed from inspection of the transparencies prepared at 65° F. from Film Unit 2-C or 2-D (indicative of more rapid clearing at 65° F.).

EXAMPLE III

Film units adapted to the provision of transparency images by diffusion transfer processing were prepared and evaluated as follows. In the case of each film unit, a multi-color photosensitive element was utilized and was prepared by coating, in succession, on a gelatin-subcoated opaque polyethylene terephthalate film base, the following layers:

1. a layer of cyan dye developer (as described hereinbefore) dispersed in gelatin and coated at a coverage of about 124 mgs./ft.$^2$ (1335 mgs./m.$^2$) of dye, about 124 mgs./ft.$^2$ (1335 mgs./m.$^2$) of gelatin, and about 17 mgs./ft.$^2$ (183 mgs./m.$^2$) of 4'-methylphenyl-hydroquinone;

2. a red-sensitive gelatino silver iodobromide emulsion layer coated at a coverage of about 140 mgs./ft.$^2$ (1507 mgs./m.$^2$) of silver and about 84 mgs./ft.$^2$ (904 mgs./m.$^2$) of gelatin;

3. an interlayer coated at a coverage of about 293 mgs./ft.$^2$ (3154 mgs./m.$^2$) of a 60-30-4-6 tetrapolymer of butylacrylate, diacetone acrylamide, styrene and methacrylic acid, about 15 mgs./ft.$^2$ (161.5 mgs./m.$^2$) of polyacrylamide permeator, and about 7 mgs./ft.$^2$ (75.4 mgs./m.$^2$) of succinaldehyde as a hardener;

4. a layer of magenta dye developer (as described hereinbefore) dispersed in gelatin and coated at a coverage of about 69 mgs./ft.$^2$ (742.7 mgs./m.$^2$) of dye, about 42 mgs./ft.$^2$ (452.1 mgs./m.$^2$) of gelatin, and about 4 mgs./ft.$^2$ (43.1 mgs./m.$^2$) of a non-diffusible magenta dye acting as a cyan filter dye in accordance with the teaching of U.S. Pat. No. 3,990,898 issued Nov. 9, 1976 to Edwin H. Land;

5. a green-sensitive gelatino silver iodobromide emulsion layer coated at a coverage of about 61 mgs./ft.$^2$ (656.6 mgs./m.$^2$) of silver and about 45 mgs./ft.$^2$ (484.4 mgs./m.$^2$) of gelatin;

6. an interlayer containing the tetrapolymer referred to above in layer 3 at a coverage of about 95 mgs./ft.$^2$ (1023 mgs./m.$^2$), about 12 mgs./ft.$^2$ (129.2 mgs./m.$^2$) of polyacrylamide, and about 4 mgs./ft.$^2$ (43.1 mgs./m$^2$) succinaldehyde as a hardener;

7. a layer of yellow dye developer (as described hereinbefore) dispersed in gelatin and coated at a coverage of about 74 mgs./ft.$^2$ (796.5 mgs./m.$^2$) of dye and about 30 mgs./ft.$^2$ (322.9 mgs./m.$^2$) of gelatin;

8. a blue-sensitive gelatino silver iodobromide emulsion layer coated at a coverage of about 92 mgs./ft.$^2$ (990.3 mgs./m.$^2$) of silver, about 51 mgs./ft.$^2$ (549.0 mgs./m.$^2$) of gelatin, and about 24 mgs./ft.$^2$ (258.3 mgs./m.$^2$) of 4'-methylphenylhydroquinone; and 9. a gelatin overcoat layer coated at a coverage of about 40 mgs./ft.$^2$ (430.6 mgs./m.$^2$) of gelatin.

In the case of each film unit, the photosensitive element hereinbefore described was exposed through a standardized multicolor strip wedge target. Following photoexposure, each photosensitive element was taped to one end of an image-receiving element in a face-to-face relationship with the respective supports outermost. A rupturable container retaining the aqueous alkaline processing composition described in EXAMPLE II hereof was fixedly mounted on the leading edge of the superposed elements to provide a film unit, so that, upon application of compressive force on the rupturable container to rupture the container's marginal seal, its contents would be distributed between the photosensitive and image-receiving elements. Each film unit was developed in the dark by passing the film unit through a pair of rollers spaced at 0.0034 inch (0.086 mm.) gap so as to uniformly distribute the processing composition between the elements as aforesaid. Development was conducted at a temperature of 75° F.

The image-receiving elements utilized in the film units as aforedescribed were Image-Receiving Elements I-A, I-B, I-C and I-D hereof. In the case of each film unit, the image-receiving element, after a period of imbibition of four minutes, was peeled apart from the developed photosensitive element with the provision in each instance of a multicolor image in the form of a transparency. The transparencies were evaluated for reticulation as follows. Each transparency was visually examined by frontal inspection under conditions of ambient light and was accorded a reticulation grade by two graders. Grades were assigned on the basis of incremental differences in reticulation in accordance with a zero-to-ten scale. The following definitions are presented as approximate characterizations of the relative levels of reticulation associated with the assigned grades: zero-no reticulation; 1-reticulation barely perceptible on close inspection; 2-slightly evident on close inspection; 3-moderately evident on close inspection; 4-clearly evident on close inspection; 5-evident on casual inspection; 6-moderate/quite noticeable; 7-very noticeable; 8-severe; 9-very severe; and 10-extreme reticulation. The grades assigned by the two graders (Grader No. 1/Grader No. 2) are reported as follows in TABLE III.

TABLE III

| Film Unit | TTM Layer(s) | Reticulation Grades |
|---|---|---|
| 2-A | TTM-A | 8/6 |
| 2-B | TTM-B | 3/2 |
| 2-C | TTM-C/TTM-D | 8/6 |
| 2-D | TTM-D/TTM-C | 4/3 |

From inspection of the reticulation data reported in TABLE III, it will be seen that the transparencies prepared from Film Unit 2-D (utilizing a combination of hydroxypropyl cellulose/cellulose acetate timing layers) show a level of reticulation somewhat less favorable than those prepared from Film Unit 2-B (utilizing a cellulose acetate timing layer) but superior to that resulting from Film Unit 2-A (utilizing a hydroxypropyl cellulose as the timing layer) and Film Unit 2-C (utilizing a combination of cellulose acetate/hydroxypropyl cellulose in the reverse sequence of that of Film Unit 2-D). As reported hereinbefore, the transparencies prepared from Film Unit 2-D showed more favorable sensitometric results and no evidence of salting relative to the transparencies from Film Unit 2-B, thus, showing a more favorable balance of properties.

EXAMPLE IV

Film units adapted to the provision of transparency images by diffusion transfer processing were prepared as follows. An image-receiving element was prepared by coating a transparent seven-mil (0.18 mm.) polyethylene glycol terephthalate film base, in succession, with the following layers:

1. as a polymeric acid layer, a mixture of about 8:1 of the partial butyl ester of polyethylene/maleic anhydride copolymer and poly(vinylbutyral) at a coverage of about 2500 mgs./ft.$^2$ (26,910 mgs./m.$^2$);

2. a layer of hydroxypropyl cellulose (Klucel L) at a coverage of about 800 mgs./ft.$^2$ (8611 mgs./m$^2$);

3. a layer of cellulose acetate having a D.S. of about 2.4 and coated at a coverage of about 100 mgs./ft.$^2$ (1076 mgs./m.$^2$); and 4. as a polymeric image-receiving layer, a mixture of (a) a graft copolymer comprised of 4-vinylpyridine (4VP) and vinylbenzyl trimethyl ammonium chloride (TMQ) grafted onto hydroxyethyl cellulose (HEC) at a ratio of HEC/4VP/TMQ of 2.2/2.2/1, (b) Pluronic F-127 polyoxyethylene polyoxypropylene block copolymer wetting agent, avg. mol. wt., about 12,500, and (c) a mixture of cis- and trans- 4,5-cyclopentatetrahydropyrimidine-2-thiol, component (a) being coated at a coverage of about 700 mgs./ft.$^2$ (7535 mgs./m.$^2$), component (b) at about 10 mgs./ft.$^2$ (107.6 mgs./m.$^2$) and component (c) at about 25 mgs./ft.$^2$ (269.1 mgs./m.$^2$); and 5. a strip-coat from a solution of gum arabic containing ammonium hydroxide and wetting agent and coated at a coverage of about 25 mgs./ft.$^2$ (269.1 mgs./m.$^2$).

The photosensitive element utilized in the preparation of the film units was comprised of an opaque subcoated polyethylene terephthalate film base having the following layers coated thereon in succession:

1. a layer of sodium cellulose sulfate coated at a coverage of about 20 mgs./m.$^2$;

2. a cyan dye developer layer comprising a cyan dye developer represented by the formula

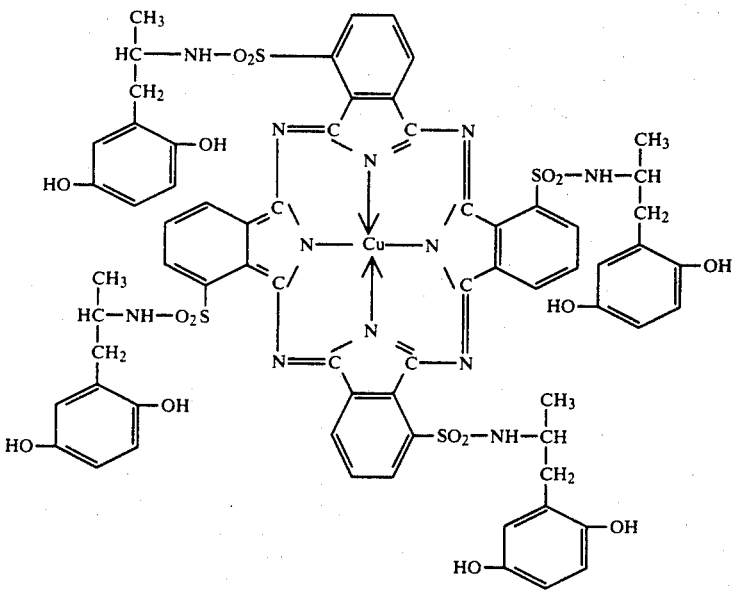

dispersed in a gelatin and coated at a coverage of about 1492 mgs./m.$^2$ of the dye developer and about 748 mgs./m$^2$ of gelatin;

3. a red-sensitive gelatino silver iodobromide emulsion layer coated at a coverage of about 1665 mgs./m.$^2$ of silver and about 991 mgs./m.$^2$ of gelatin;

4. an interlayer comprising about 1400 mgs./m.hu 2 of a 60.6/29/6.3/3.7/0.4 pentapolymer of butylacrylate, diacetone acrylamide, styrene, methacrylic acid and acrylic acid and about 58 mgs./m.$^2$ of polyacrylamide;

5. a layer comprising the magenta dye developer

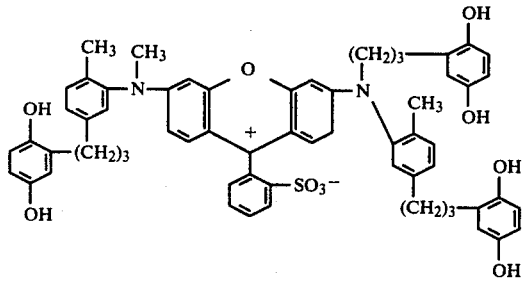

dispersed in gelatin and coated at a coverage of about 880 mgs./m.$^2$ of dye and about 441 mgs./m.$^2$ of gelatin;

6. a green-sensitive gelatino silver iodobromide emulsion layer coated at a coverage of about 1056 mgs./m.$^2$ of silver and about 465 mgs./m.$^2$ of gelatin;

7. an interlayer comprising about 1600 mgs./m.$^2$ of a 60.6/29/6.3/3/7/0.4 pentapolymer of butylacrylate, diacetone acrylamide, styrene, methacrylic acid and acrylic acid and about 178 mgs./m.$^2$ of polyacrylamide;

8. a layer comprising the yellow dye developer

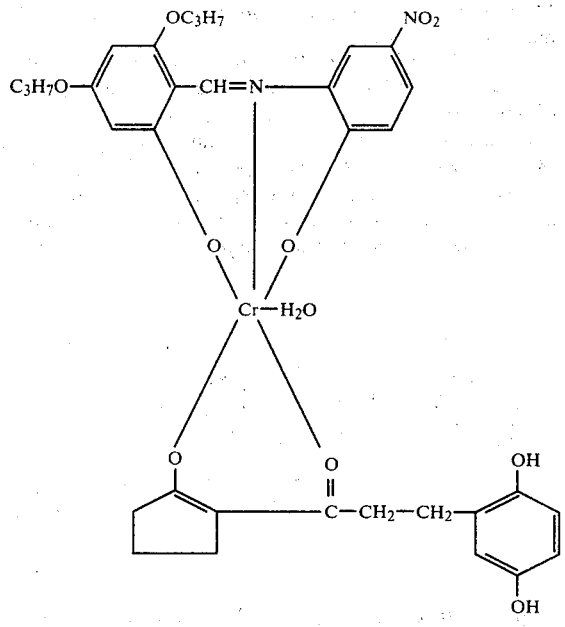

dispersed in gelatin and coated at a coverage of about 1104 mgs./m.$^2$ of dye and about 442 mgs./m.$^2$ of gelatin;

9. a blue-sensitive gelatino silver iodobromide emulsion layer coated at a coverage of about 1248 mgs./m.$^2$ of silver, about 801 mgs./m.$^2$ of gelatin, and about 398 mgs./m.$^2$ of 4'-methylphenylhydroquinone; and 10. a gelatin overcoat layer coated at a coverage of about 430 mgs./m.$^2$ of gelatin.

A rupturable container, retaining the processing composition described in EXAMPLE II hereof, was fixedly mounted at the leading edge of the face side of the image-receiving element, such that placement of the photosensitive element thereon would provide a film unit comprising the image-receiving and photosensitive elements in a face-to-face relation (their supports outermost) with the rupturable container therebetween at the leading edge. Following exposure of the photosensitive element, by subjecting the element to a standardized sensitometric exposure, the element was brought into a superposed relationship with the image-receiving element as aforedescribed. Passage of the resulting film unit (in the dark) between a pair of pressure-applying rollers having a gap of about 0.0036 inch (0.091 mm.) effected rupture of the marginal seal of the rupturable container and distribution of the contents thereof uniformly between the photosensitive and image-receiving elements. Development was effected at temperatures of 65° F., 75° F. and 85° F. Following an imbibition period of four minutes in each case, the resulting transparency was separated from the exposed photosensitive element for mounting in a suitable frame for projection viewing.

Transparencies produced from the film units aforedescribed provided good sensitometric results and exhibited good temperature latitude performance. Projection viewing produced no objectionable level of reticulation.

What is claimed is:

1. An image-receiving element for use in a diffusion transfer photographic process adapted to the provision of a transparency image comprising a transparent support carrying, in sequence, an acid-reacting reagent layer; a first polymeric timing layer possessing decreasing alkaline solution-permeability with increasing temperature; a second timing layer comprising cellulose acetate; and an alkaline solution-permeable and dyeable polymeric image-receiving layer on said cellulose acetate timing layer, said image-receiving layer comprising a graft polymer having the formula

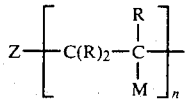

wherein Z is an organic polymeric backbone and wherein the grafted entity,

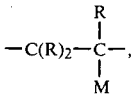

is the grafted residue of a graftable compound where M is a moiety which can provide a mordant capability, each R is the same or different substituent which will not hinder grafting of the mordant through the vinyl group, and n is a positive integer.

2. The image-receiving element of claim 1 wherein said cellulose acetate timing layer has a degree of substitution of from about 1.0 to about 3.0.

3. The image-receiving element of claim 2 wherein said cellulose acetate timing layer comprises a layer of cellulose acetate having a degree of substitution of about 2.4.

4. The image-receiving element of claim 1 wherein said polymeric backbone Z of said graft polymer comprises a backbone polymer selected from the group consisting of polyvinyl alcohols, poly-N-vinylpyrollidones, polyacrylamides and cellulosic polymers.

5. The image-receiving element of claim 1 wherein said polymeric backbone Z of said graft polymer comprises a cellulosic backbone polymer and wherein said grafted entity

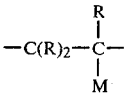

comprises a grafted residue of a vinylbenzyl ammonium halide and n is a positive integer.

6. The image-receiving element of claim 5 wherein said cellulosic backbone polymer comprises a hydroxyethyl cellulose backbone polymer.

7. The image-receiving element of claim 6 wherein a vinylpyridine and a vinylbenzyl ammonium halide are grafted to said hydroxyethyl cellulose backbone.

8. The image-receiving element of claim 7 wherein said vinylpyridine comprises 4-vinylpyridine.

9. The image-receiving element of claim 8 wherein the weight ratio of hydroxyethyl cellulose/4-vinylpyridine/vinylbenzyl ammonium halide is about 2.2/2.2/1.

10. The image-receiving element of claim 9 wherein said transparent support comprises polyethylene glycol terephthalate.

11. The image-receiving element of claim 1 wherein said first and second timing layers are contiguous to one another.

12. The image-receiving element of claim 1 wherein said first polymeric timing layer possessing decreasing alkaline solution-permeability with increasing temperature comprises hydroxypropyl cellulose.

13. The image-receiving element of claim 12 wherein said second timing layer comprises cellulose acetate having a degree of substitution of from about 1.0 to about 3.0.

14. The image-receiving element of claim 13 wherein said second timing layer comprises cellulose acetate having a degree of substitution of about 2.4.

15. The image-receiving element of claim 14 wherein said first and second timing layers are contiguous to one another.

16. A diffusion transfer film unit for use in a diffusion transfer photographic process adapted to the provision of a transparency image comprising: a photosensitive element comprising at least one silver halide emulsion layer having associated therewith an image dye-providing material;

an image-receiving element adapted to be separated from said photosensitive element after transfer image formation and comprising a transparent support carrying, in sequence, an acid-reacting reagent layer; a first polymeric timing layer possessing decreasing alkaline solution-permeability with increasing temperature; a second-timing layer comprising cellulose acetate; and an alkaline solution-permeable and dyeable polymeric image-receiving layer on said cellulose acetate timing layer, said image-receiving layer comprising a graft polymer having the formula

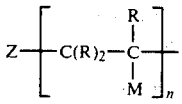

wherein Z is an organic polymeric backbone and wherein the grafted entity,

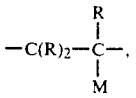

is the grafted residue of a graftable compound where M is a moiety which can provide a mordant capability, each R is the same or different substituent which will not hinder grafting of the mordant through the vinyl group, and n is a positive integer; and integrated with said photosensitive and image-receiving elements, means for retaining a processing composition such that the processing composition can be distributed between the superposed elements after photoexposure of the photosensitive element.

17. The diffusion transfer film unit of claim 16 wherein said cellulose acetate timing layer has a degree of substitution of from about 1.0 to about 3.0.

18. The diffusion transfer film unit of claim 17 wherein said cellulose acetate timing layer comprises a layer of cellulose acetate having a degree of substitution of about 2.4.

19. The diffusion transfer film unit of claim 16 wherein said polymeric backbone Z of said graft polymer comprises a backbone polymer selected from the group consisting of polyvinyl alcohols, poly-N-vinylpyrollidones, polyacrylamides and cellulosic polymers.

20. The diffusion transfer film unit of claim 16 wherein said polymeric backbone Z of said graft polymer comprises a cellulosic backbone polymer and wherein said grafted entity

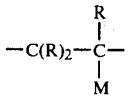

comprises a grafted residue of a vinylbenzyl ammonium halide and n is a positive integer.

21. The diffusion transfer film unit of claim 20 wherein said cellulosic backbone polymer comprises a hydroxyethyl cellulose backbone polymer.

22. The diffusion transfer film unit of claim 21 wherein a vinylpyridine and a vinylbenzyl ammonium halide are grafted to said hydroxyethyl cellulose backbone.

23. The diffusion transfer film unit of claim 22 wherein said vinylpyridine comprises 4-vinylpyridine.

24. The diffusion transfer film unit of claim 23 wherein the weight ratio of hydroxyethyl cellulose/4-vinylpyridine/vinylbenzyl ammonium halide is about 2.2/2.2/1.

25. The diffusion transfer film unit of claim 16 wherein said first and second timing layers are contiguous to one another.

26. The diffusion transfer film unit of claim 16 wherein said first polymeric timing layer possessing decreasing alkaline solution-permeability with increasing temperature comprises hydroxypropyl cellulose.

27. The diffusion transfer film unit of claim 26 wherein said second timing layer comprises cellulose acetate having a degree of substitution of from about 1.0 to about 3.0.

28. The diffusion transfer film unit of claim 27 wherein said second timing layer comprises cellulose acetate having a degree of substitution of about 2.4.

29. The diffusion transfer film unit of claim 28 wherein said first and second timing layers are contiguous to one another.

30. A process for forming a diffusion transfer transparency which comprises the steps of: developing an exposed photosensitive element comprising at least one silver halide emulsion layer having associated therewith an image dye-providing material, by contacting said element with a processing composition, immobilizing said dye as a result of development, forming thereby an imagewise distribution of mobile dye as a function of the point-to-point degree of exposure of said photosensitive element and transferring by imbibition at least a portion of said imagewise distribution of mobile dye to a superposed image-receiving element, said image-receiving element being adapted to separation from said photosensitive element after transfer image formation and comprising a transparent support carrying, in sequence, an acid-reacting reagent layer; a first polymeric timing layer possessing decreasing alkaline solution-permeability with increasing temperature; a second timing layer comprising cellulose acetate; and an alkaline solution-permeable dyeable polymeric image-receiving layer on said cellulose acetate timing layer, said image-receiving layer comprising a graft polymer having the formula

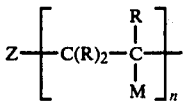

wherein Z is an organic polymeric backbone and wherein the grafted entity,

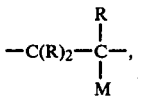

is the grafted residue of a graftable compound where M is a moiety which can provide a mordant capability, each R is the same or different substituent which will not hinder grafting of the mordant through the vinyl group, and n is a positive integer.

31. The diffusion transfer process of claim 30 wherein said cellulose acetate timing layer has a degree of substitution of from about 1.0 to about 3.0.

32. The diffusion transfer process of claim 31 wherein said cellulose acetate timing layer comprises a layer of cellulose acetate having a degree of substitution of about 2.4.

33. The diffusion transfer process of claim 30 wherein said polymeric backbone Z of said graft polymer comprises a backbone polymer selected from the group consisting of polyvinyl alcohols, poly-N-vinylpyrollidones, polyacrylamides and cellulosic polymers.

34. The diffusion transfer process of claim 30 wherein said polymeric backbone Z of said graft polymer comprises a cellulosic backbone polymer and wherein said grafted entity

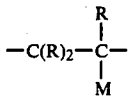

comprises a grafted residue of a vinylbenzyl ammonium halide and n is a positive integer.

35. The diffusion transfer process of claim 34 wherein said cellulose backbone polymer comprises a hydroxyethyl cellulose backbone polymer.

36. The diffusion transfer process of claim 35 wherein a vinylpyridine and a vinylbenzyl ammonium halide are grafted to said hydroxyethyl cellulose backbone.

37. The diffusion transfer process of claim 36 wherein said vinylpyridine comprises 4-vinylpyridine.

38. The diffusion transfer process of claim 37 wherein the weight ratio of hydroxyethyl cellulose/4-vinylpyridine/vinylbenzyl ammonium halide is about 2.2/2.2/1.

39. The diffusion transfer process of claim 30 wherein said first and second timing layers are contiguous to one another.

40. The diffusion transfer process of claim 30 wherein said first polymeric timing layer possessing decreasing alkaline solution-permeability with increasing temperature comprises hydroxypropyl cellulose.

41. The diffusion transfer process of claim 40 wherein said second timing layer comprises cellulose acetate having a degree of substitution of from about 1.0 to about 3.0.

42. The diffusion transfer process of claim 41 wherein said second timing layer comprises cellulose acetate having a degree of substitution of about 2.4.

43. The diffusion transfer process of claim 42 wherein said first and second timing layers are contiguous to one another.

* * * * *